United States Patent [19]

Binninger

[11] 3,995,672

[45] Dec. 7, 1976

[54] APPARATUS FOR AUTOMATIC WOODSPLITTING

[76] Inventor: Michael B. Binninger, 135 Rideout Way, Marysville, Calif.

[22] Filed: Sept. 10, 1975

[21] Appl. No.: 611,844

[52] U.S. Cl. ..... 144/193 A; 83/4

[51] Int. Cl.[2] ..... B27L 7/00

[58] Field of Search ..... 144/193 A, 193 R; 83/4

[56] References Cited

UNITED STATES PATENTS

| | | | |
|---|---|---|---|
| 873,418 | 12/1907 | Eckenroth | 144/193 A |
| 3,356,115 | 12/1967 | Cole | 144/193 R |

FOREIGN PATENTS OR APPLICATIONS

| | | | |
|---|---|---|---|
| 233,927 | 5/1961 | Australia | 144/193 A |

*Primary Examiner*—Donald R. Schran

*Attorney, Agent, or Firm*—Phillips, Moore, Weissenberger, Lempio & Strabala

[57] ABSTRACT

Apparatus capable of automatically splitting logs into portions of given maximum cross-sectional dimensions regardless of the cross-sectional size of the logs to be split is disclosed. Preferred structures of the apparatus for splitting short logs into firewood and for splitting longer logs into fenceposts are described. A preferred electrohydraulic operating system is disclosed.

9 Claims, 8 Drawing Figures

APPARATUS FOR AUTOMATIC WOODSPLITTING

BACKGROUND OF THE INVENTION

This invention relates to apparatus for splitting wood by forcing a log to be split against a fixed blade and more particularly to such apparatus capable of automatically splitting the logs into portions of given maximum cross-sectional dimensions regardless of the cross-sectional dimensions of such logs.

In splitting wood, as distinguished from cutting wood, a knife edge wedge is forced into the grain of the wood to cause the fibers thereof to separate along a line that follows such fibers. Thus, the total energy required to separate the wood into portions is reduced but the contour of the portions is largely dependent on the arrangement of the fibers in the grain of the wood.

It is known in the prior art to split wood by forcing logs or the like endwise along a bed and against a wedge-like blade or knife, rigidly mounted on such bed, in order to divide such log or the like into two or more substantially equal portions. According to the teaching of U.S. Pat. No. 873,418 to Eckenroth Jr. a steam actuated ram is used to force the log endwise along the bed and against a wedge or knife having two cutting surfaces crossing each other at right angles. The wedge or knife is adjusted with respect to the bed for each log so that the intersection of the cutting surfaces is positioned at the center of the cross-section of the log in order to split the log into four quarters, the cross-sectional dimensions of which will depend on the cross-sectional dimensions of the log. Thus, the apparatus taught by Eckenroth Jr. must be adjusted for each log and is not capable of automatic operation or of producing portions having given maximum cross-sectional dimensions.

In U.S. Pat. No. 3,077,214 to Brunkner, apparatus is disclosed which is capable of automatically splitting logs, having a range of cross-sectional dimensions, substantially in half. According to the teaching of Brunkner, a hydraulic ram is used to force the logs endwise along a bed against a wedge assembly comprising an axe blade or wedge rigidly mounted on the bed and having its cutting edge extending normally to the bed. A wedge plate of relatively wide divergence is rigidly mounted on the free end of the axe blade and spaced rearwardly of the cutting edge with respect to the log for the purpose of spreading the halves of the splitting log thereby breaking the fibers above the reach of the axe blade and increasing the maximum diameter of log which the apparatus can split. Mechanical link means are used to control the hydraulic ram in order to provide automatic operation for splitting logs within the given range of cross-sectional dimensions into two halves, the cross-sectional dimensions of which are dependent on the log split.

It is a particular object of this invention to provide apparatus capable of splitting logs into portions of given maximum cross-sectional dimensions regardless of the cross-sectional size of the log to be split.

It is a general object of this invention to provide improved apparatus for automatically splitting logs of varying cross-sectional size and length.

SUMMARY OF THE INVENTION

Briefly, the improved apparatus according to this invention comprises an elongated bed for supporting a log to be split with a splitting blade assembly mounted at one end and a hydraulic ram structure including a wall mounted at the other end for exerting force on the log endwise along the bed between the wall and the splitting blade assembly. The splitting blade assembly comprises a generally horizontal splitting blade extending at least the full diameter of the log to be split spaced above the bed by a distance less than the horizontal extent thereof and a generally vertical splitting blade extending only between the horizontal blade and the bed with the cutting edge of the horizontal blade closer to the ram than the cutting edge of the vertical blade. Means are provided for actuating the hydraulic ram structure including a reservoir for hydraulic fluid, a hydraulic fluid pump and means for driving the pump and controlling the flow of hydraulic fluid to and from the hydraulic ram structure.

BRIEF DESCRIPTION OF THE DRAWING

The foregoing and other objects and features of the subject invention will be more fully understood from a reading of the following detailed description of preferred embodiments thereof in conjunction with the drawing wherein.

DETAILED DESCRIPTION OF PREFERRED EMBODIMENTS

Figure 1:
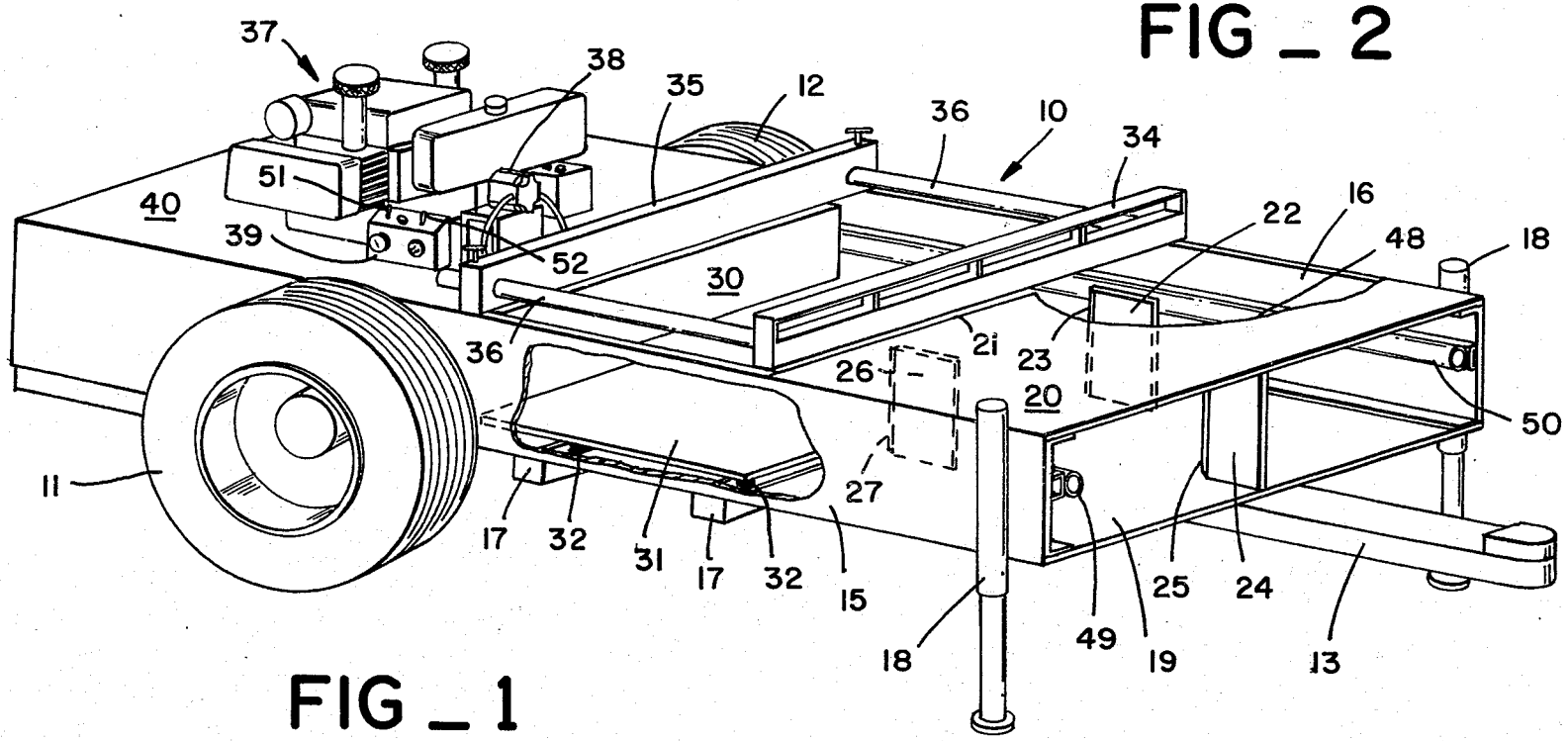
FIG. 1 is a persective view of one preferred embodiment of the apparatus according to the subject invention.

Referring to FIG. 1, a log splitting apparatus in accordance with one embodiment of this invention is shown in perspective with portions broken away to reveal certain internal structures of the apparatus. According to this embodiment of the invention, the apparatus is constructed in the form of a trailer in order to provide mobility so that the apparatus may be easily moved to the vicinity of a supply of logs to be split. Thus, the apparatus 10, according to this embodiment of the invention, comprises a generally rectangular, substantially hollow, box-like frame mounted on a pair of wheels 11, 12 by any conventional means. A towing tongue 13 is mounted at one end of the apparatus 10 to provide for the attachment thereof to a towing vehicle.

A pair of heavy steel channel members 15 and 16 form the elongated sides of the rectangular main frame of the apparatus 10. The lower edges of the channel members 15 and 16 are interconnected by transversely extending structural members such as girders 17, for example, to provide the rigid bed of the apparatus 10. A pair of telescoping legs 18 may be rigidly fixed to the outer surface of the channel members 15 and 16 at the end thereof adjacent the tongue 13 in order to provide for stability of the apparatus in operation when detached from the towing vehicle.

According to the embodiment of this invention shown in FIG. 1, the end portion of the bed of the apparatus 10 adjacent the tongue 13 is formed by a heavy metal plate 19 extending between the lower portions of the channel members 15 and 16 and rigidly fixed thereto as by bolting or welding. As will be more fully explained hereinafter, such metal plate 19 supports the portions split from the log and insures that the splitting operation will be fully and efficiently completed as well as adding structural rigidity to the frame of the apparatus 10.

Similarly, a splitting blade assembly is rigidly mounted on the frame of the apparatus 10 at the end thereof adjacent the tongue 13. Such splitting blade assembly comprises a generally horizontal splitting blade 20 provided by a heavy metal plate extending transversely between the upper edges of the channel members 15 and 16 and rigidly affixed thereto as by means of bolting or welding. The edge 21 of the metal plate remote from the tongue 13 is beveled or sharpened to provide a splitting edge against which a log is forced by the apparatus 10 according to this invention. The splitting blade assembly also includes one or more vertical splitting blades 22, 24 and 26 extending only toward the bed of the apparatus 10 from the lower surface of the horizontal splitting blade 20. Each of such vertical splitting blades may comprise a heavy metal plate rigidly affixed to the lower surface of the horizontal splitting blade as by means of welding, for example, and having the edge thereof remote from the tongue 13 beveled or sharpened to provide a splitting edge 23, 25, 27, respectively, against which a log to be split is forced by the apparatus 10 according to the teaching of this invention. In the embodiment shown in FIG. 1, the lower ends of the vertical splitting blades 22, 24, 26 are also rigidly affixed to the upper surface of the metal plate 19 as by welding, for example, in order to provide an extremely rigid splitting blade assembly.

Figure 2:
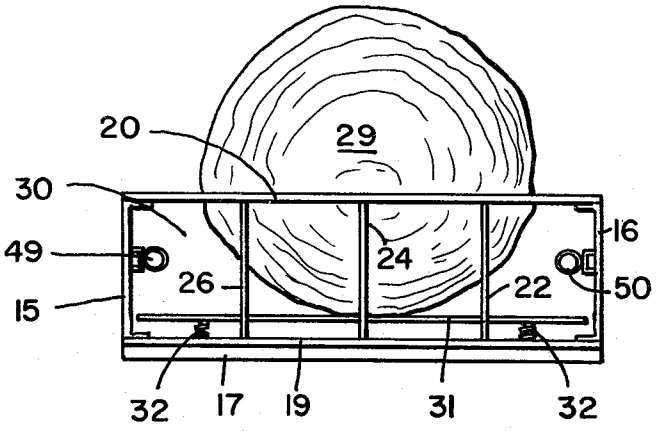
FIG. 2 is a simplified end view of the splitting blade assembly of the apparatus of FIG. 1 showing a log in the process of being split thereby.
Figure 3:
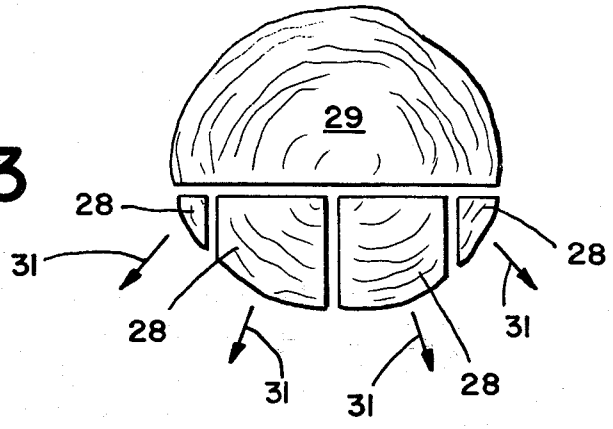
FIG. 3 is an end view of the log of FIG. 2 showing the portions to be split therefrom with the composite force to which each portion is subjected in the splitting process indicated by arrows.

According to the teaching of this invention, the apparatus 10 includes a hydraulic ram structure, only the movable end 30 of which is visible in FIG. 1, for forcing a log endwise along the bed of the apparatus 10 and against the splitting blade assembly. The hydraulic ram structure will be more fully described hereinafter, however, it will be understood that a log 29 is placed on the bed of the apparatus 10 with one end adjacent the splitting blade assembly and the other end adjacent the movable end 30 of the hydraulic ram structure. When the hydraulic ram structure is actuated, the end 30 thereof will be moved toward the splitting blade assembly forcing the log against the splitting edges 21, 23, 25 and 27 of the horizontal splitting blade 20 and vertical splitting blades 22, 24 and 26. As best illustrated in FIGS. 2 and 3, the splitting blades 20, 22, 24 and 26 will be forced into the grain of the log tending to separate the fibers thereof and splitting portions 28 away from the main body of the log 29. Thus, at the completion of the splitting movement of the end 30 of the hydraulic ram structure, the unsplit portion of the log 29 will have been forced to a position in which it rests on top of the generally horizontal splitting blade 20 with the split portions 28 of the log being received under the generally horizontal splitting blade 20 and between the vertical splitting blades 22, 24 and 26. The split portions 28 of the log 29 will, of course, be subjected to transverse forces by the horizontal and vertical splitting blades, the resultant of such forces and the direction in which the split portions 28 tend to move, being indicated by the arrows 31 in FIG. 3. Thus, it will be seen that the apparatus 10 and splitting blade assembly thereof must be properly designed in order to avoid binding of the split portions 28 of the log 29 within the splitting blade assembly. To this end, the log 29 is resiliently supported above the bed of the apparatus 10 prior to the actual splitting thereof and the splitting blades of the splitting blade assembly are arranged with respect to each other in order to accommodate the forces imposed on the split portions 28 of the log 29 by the splitting operation.

As best shown in FIGS. 1 and 2, the log 29 is resiliently supported prior to the splitting operation by means of a heavy metal plate 31 carried by means of compression springs 32 on the girders 17 slightly above the bed of the apparatus 10. The movable end 30 of the hydraulic ram structure moves across the upper surface of the support plate 31 forcing the log 29 to slide endwise from the support plate 31 and into the splitting blade assembly. The springs 32 will enable the support plate 31 to move vertically with respect to the bed of the apparatus 10 or tilt with respect thereto in order to accommodate forces imposed on the log 29 during the splitting operation by the splitting blades particularly where the log 29 includes knots internally thereof or protrusions externally thereof.

Figure 4:
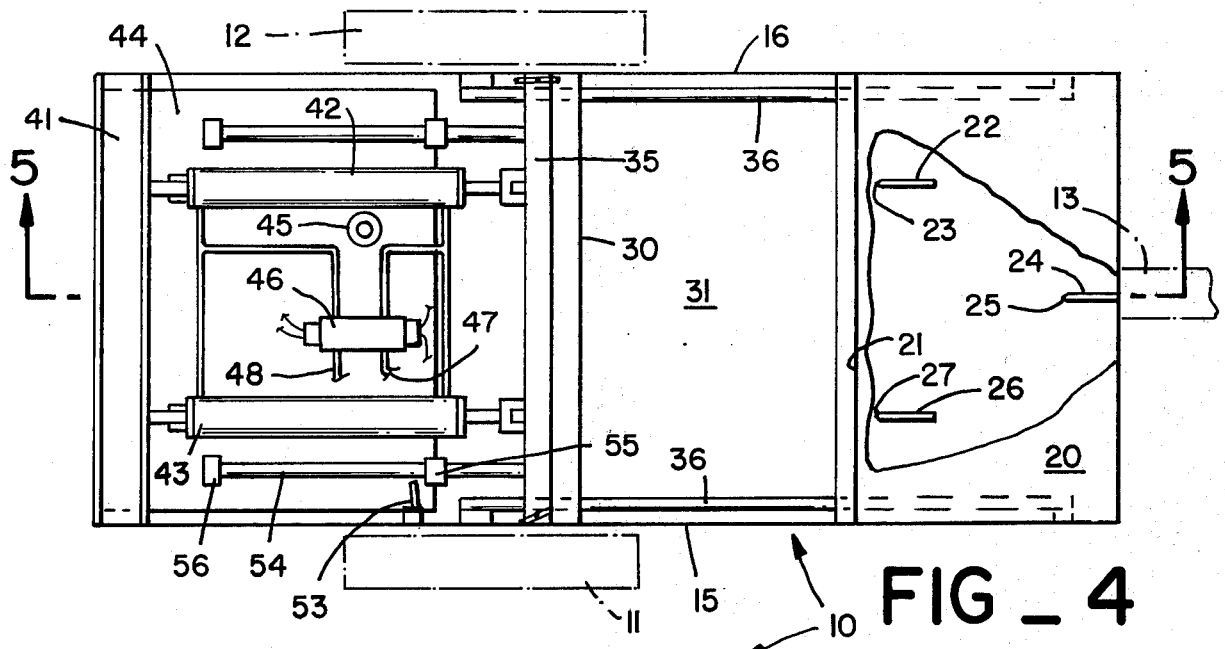
FIG. 4 is a top view of the apparatus of FIG. 1 with portions thereof omitted and other portions broken away or shown in section for clarity of illustration.

As best shown in FIGS. 1 and 4, it will be seen that the splitting edge 21 of the generally horizontal splitting blade 20 is spaced further from the tongue and of the apparatus 10 than the splitting edges of any of the vertical splitting blades 22–26. Thus, the log 29 encounters the splitting edge 21 of the horizontal splitting blade 20 first and the portion thereby split from the log 29 subsequently encounters the vertical splitting blades 22–26. The splitting edges 23 and 27 of the two outer vertical splitting blades 22 and 26 are spaced further from the tongue end of the apparatus 10 than the splitting edge 25 of the centrally located vertical splitting blade 24. Thus, the outward deflection of the outer split portions 28 of the log is readily accommodated and the outward deflection of the two halves of the central portion when it encounters the vertical splitting blade 24 may also be readily accommodated.

As best shown in FIG. 2, the downward deflection of the central portions of the split log is also accommodated due to the support of the log above the bed of the apparatus by means of the spring mounted plate 31. Thus, the tendency of the split portions 28 of the log 29 to bind within the splitting blade assembly is greatly reduced in the apparatus 10 according to the teaching of this invention.

As best shown in FIG. 1, a means is provided for returning the uncut portion of the log from the top of the generally horizontal cutting blade 20 into the apparatus 10 for further splitting. Thus, a bar structure 34 is supported immediately above the upper surface of the generally horizontal splitting blade 20 from the movable end 30 of the hydraulic ram structure by means of a yoke 35 and a pair of rods 36. Thus, when the ram structure is actuated to move the end 30 thereof toward the splitting blade assembly, the bar structure 34 will be moved along the upper surface of the generally horizontal cutting blade 20 toward the tongue end of the apparatus 10. When the splitting operation is completed, the unsplit portion of the log 29 will rest on the upper surface of the horizontal cutting blade 20 and the bar structure 34 will be positioned beyond the end of the uncut portion of the log 29. When the hydraulic ram structure is actuated to retract the end 30, the yoke 35 and rods 36 will pull the bar structure 34 rearwardly tending to slide the uncut portion of the log 29 along the top of the horizontal splitting blade 20 and reposition it in the apparatus 10 between the movable end 30 of the ram structure and the splitting blade assembly on the support plate 31. When the ram structure is again actuated, the previously unsplit portion of the log 29 will be forced against the splitting blade structure resulting in the splitting thereof as well as in the forcing of the previously split portions 28 from between the horizontal splitting blade 20 and support plate 19.

Figure 5:
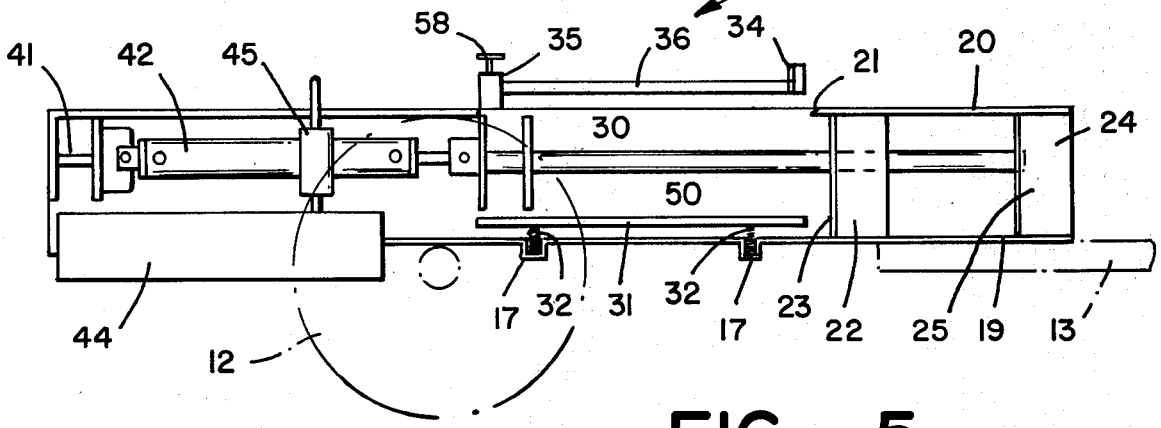
FIG. 5 is a cross-sectional view taken along line 5—5 of FIG. 4 and omitting the same portions as omitted from FIG. 4.

In the apparatus according to the embodiment of this invention as shown in FIGS. 1, 4 and 5, a double-acting hydraulic ram structure is used. Referring to FIG. 1, a gasoline engine indicated generally at 37 provides the power necessary to drive a hydraulic pump 38 which supplies hydraulic fluid under pressure to the hydraulic ram structure. The gasoline engine 37 and pump 38 together with an appropriate control box 39 may be mounted on a metal plate 49 rigidly fixed to the upper edges of the channel members 15 and 16 at the end of the apparatus 10 remote from the tongue 13. Although any appropriate means for mounting the engine 37, pump 38 and control box 39 could be used, the use of the metal plate 40 helps to make the apparatus 10 extremely rugged and provides an enclosure for the double-acting hydraulic ram structure.

Referring to FIG. 4, a top plan view of the apparatus 10 of FIG. 1 is shown with the engine 37, pump 38, control box 39 and mounting plate 40 removed and with other portions broken away or shown in phantom for clarity. FIG. 5 is a cross-sectional view taken along lines 5—5 of FIG. 4 and the following description of FIGS. 4 and 5 is directed primarily to the double-acting hydraulic ram structure and its mechanical interrelationship with the remainder of the apparatus.

Thus, a heavy steel I-beam 41 is rigidly fixed between the channel members 15 and 16 at the end thereof remote from the tongue 13 to provide a rugged mounting member for the hydraulic ram structure. Such hydraulic ram structure according to this embodiment of the invention, comprises a pair of double-acting hydraulic motors 42 and 43. The cylinders of the hydraulic motors 42 and 43 are mechanically coupled to the I-beam 41 in the usual manner and the pistons of the hydraulic motors 42 and 43 are mechanically coupled to the movable end wall 30 of the hydraulic ram structure in the usual manner. The hydraulic motors 42 and 43 are hydraulically connected in parallel so that the pistons thereof will be extended and retracted in tandem to force the movable wall 30 toward and away from the splitting blade structure at the tongue end of the apparatus.

A tank or reservoir 44 of hydraulic fluid is mounted between the channel members 15 and 16 below the hydraulic motors 42 and 43. The reservoir 44 is connected to the hydraulic pump through an oil filter 45 and the parallel connected hydraulic motors 42 and 43 are connected through an electrically actuated two-position four-way valve 46 to the output of the hydraulic pump 38 and the reservoir 44 by means of hydraulic lines 47 and 48 respectively. A pair of guide rods 49 and 50 are provided along the inner surfaces of the channel members 15 and 16 for supporting and guiding the movable end 30 of the hydraulic ram structure as it is extended and retracted by the operation of the hydraulic motors 42 and 43.

Thus, when the two-position four-way valve 46 is electrically actuated to its first position, the hydraulic pump will be connected to the drive rod side of the pistons in the cylinders of both of the parallel connected hydraulic motors 42 and 43 and the opposite sides of such pistons will be connected to the reservoir 44 thus retracting the movable end 30 of the hydraulic ram structure to the position shown in FIG. 4. When the two-position four-way valve 46 is electrically actuated to the second of its two positions, the rod side of the pistons of the parallel connected hydraulic motors 42 and 43 will be connected to the reservoir and the other side of such pistons will be connected to the output of the hydraulic pump 38 thereby extending the drive rods of the hydraulic motors 42 and 43 forcing the movable end 30 of the hydraulic ram structure toward the splitting blade structure along the guide rods 49 and 50 and over the upper surface of the support plate 31. Appropriate electrical circuitry including a manually operable single pole double throw switch 51 is included in the control box 39 to enable manual actuation of the two-position four-way valve 46 so that the operator can control the extension and retraction of the movable end 30 of the hydraulic ram structure in any desired sequence. In addition, a second manually operable single-pole double throw switch 52 is included in the control box 39 and electrically connected in the circuitry to enable the manual control switch 51 to be disconnected from the circuit and an automatically operated single pole double throw switch 53 (see FIG. 4) to be connected in its place. As indicated in FIG. 4, the automatically actuated single pole double throw switch 52 may be a so-called "toggle" switch mounted on one of the channel members 15 or 16 rearwardly of the movable wall 30 of the hydraulic ram structure. An appropriate actuation rod 54 is mounted on the movable end wall 30 of the hydraulic ram structure in a position to enable protruding actuator structures mounted on such rod 54 to engage the toggle of the switch 53 at each end of the stroke of the hydraulic ram structure 30. Thus in the position shown in FIG. 4, the actuator protrusion 55 has just actuated the toggle of the switch 53 at the end of the retraction cycle of the hydraulic ram structure thereby placing the switch 52 in a position to actuate the two-position four-way valve 46 to its second position in order to start the extension portion of the stroke of the hydraulic ram structure assuming that the switch 53 is connected into the electrical circuit of the apparatus by the switch 52. It will be understood that the actuator protrusion 56 mounted on the free end of the actuator rod 54 will contact the toggle of the switch 53 to end the extension portion of the hydraulic ram structure when the movable wall 30 thereof has reached substantial alignment with the splitting edge 21 of the horizontal splitting blade 20 and begin the retraction portion of the stroke of the hydraulic ram structure by actuating the two-position four-way valve 46 to the first position thereof as described above. Thus, so long as the switch 53 is connected into the electrical circuitry of the apparatus by the switch 52, the hydraulic ram structure will cycle through its stroke continuously. The actuator protrusion 55 on the rod 54 may be adjustable along such rod 54 in order to control the length of the stroke of the hydraulic ram structure in accordance with the length of the logs to be split.

Apparatus in accordance with the teaching of this invention and particularly the embodiment shown in FIGS. 1, 4 and 5, may be designed to enable it to split logs up to 6 or 7 feet in length so that at least some of the split portions thereof may be used as fenceposts. The split portions selected for such use will, of course, be those having cross-sectional dimensions approaching the maximum cross-sectional dimensions determined by the splitting blade structure as shown in FIGS. 2 and 3. In order to provide a stroke of sufficient length, the hydraulic ram structure may utilize double extension hydraulic motors and the horizontal blade 20 would have to be of sufficient length to support the unsplit portions of the logs 29 so that they can be moved into position for splitting upon actuation of the hydraulic motors to retract the hydraulic ram structure. Due to the length and consequent weight of logs used to provide fenceposts, it may be necessary to utilize mechanical means for loading the logs into the apparatus for splitting. However, the length and weight of the logs should insure the proper positioning of unsplit portions thereof in the apparatus for subsequent splitting. As best shown in FIG. 5 an appropriate means 58 may be provided for adjusting the spacing between the bar 34 and the movable end 30 of the hydraulic ram structure in accordance with the length of the stroke of the hydraulic ram structure. Such means may include apertures through the yoke 35 receiving the rods 36 together with a set screw mechanism for fixing such rods 36 in such apertures at any point along their length.

Figure 6:
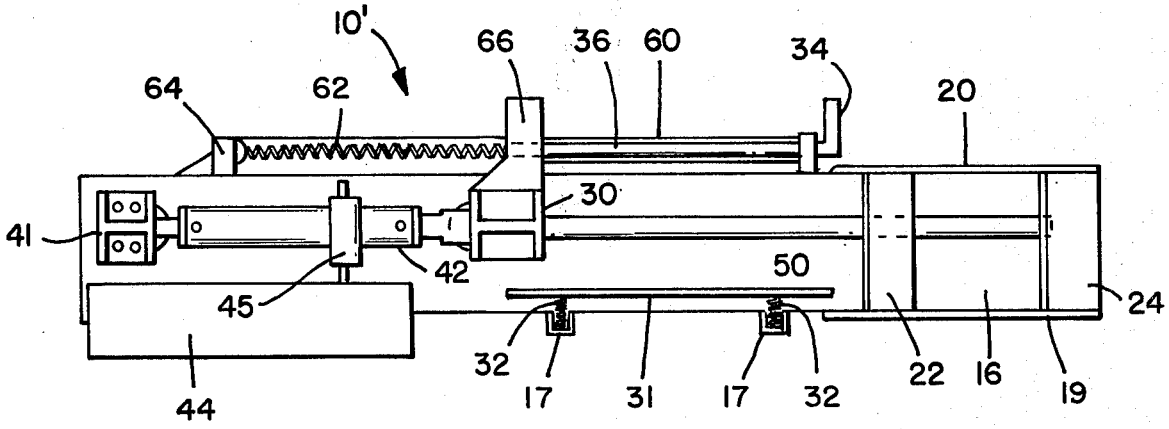
FIG. 6 is a cross-sectional view similar to FIG. 5 but showing a different embodiment of the apparatus according to the teaching of this invention as preferred for use in splitting logs into firewood.

Referring to FIG. 6, an apparatus 10' in accordance with an embodiment of this invention which is preferred for use in splitting shorter logs into firewood is shown. The apparatus 10' of FIG. 6 is substantailly identical to the apparatus 10 shown in FIGS. 1, 4 and 5, except for its size and the mechanism used to return the unsplit portion of the log from the top of the horizontal blade 20 into the apparatus for subsequent splitting. Thus, the same reference numerals have been used in FIG. 6 to identify the parts thereof which correspond to the parts of the apparatus 10 of FIGS. 1, 4 and 5. Thus, in the apparatus 10' of FIG. 6, the rods 36 which support the return bar 34 are not connected to the movable end 30 of the hydraulic ram structure. Instead, such rods 36 are received in support tubes 60 for telescoping movement with respect thereto. The support tubes 60 are mounted on the channel members 15 and 16 and tension springs 62 are provided for biasing the rods 36 to their fully telescoped position within the support tubes 60. As shown in FIG. 6, a tension spring 62 may be connected between the free end of each rod 36 remote from the bar 34 and an appropriate dead man 64 rigidly mounted on the upper edge of the channel members 15 and 16 rearwardly of the movable end 30 of the hydraulic ram structure in its fully retracted position. The movable end 30 of the hydraulic ram structure is provided with an upwardly extending portion 66 for engaging the unsplit portion of the log which will be forced on top of the horizontal splitting blade 20 during the splitting operation.

Thus, during the splitting operation, the unsplit portion of the log will be forced against the rod 34 by the upwardly extending portion 66 of the movable wall 30 of the hydraulic ram structure. As the log is split by the splitting blade assembly upon extension of the hydraulic ram structure the unsplit portion thereof will be held firmly between the rod 34 and the upwardly extending portion 66 of the movable wall 30 and will be moved along the upper surface of the horizontal splitting blade 20 against the force of the tension springs 62. Upon retraction of the movable wall 30 of the hydraulic ram structure, the force of the tension springs 62 will continue to hold the unsplit portion of the log between the rod 34 and upwardly extending portion 66 thereof until the bar 34 has returned to its normal position to which it is biased by the tension springs 62. At this point, further retraction of the movable wall 30 and upwardly extending portion 66 thereof will release the unsplit portion of the log allowing it to drop into the apparatus 10' onto the plate 31 for subsequent splitting. It will be seen that the apparatus 10' will tend to insure the proper orientation of the unsplit portion of the log for subsequent splitting.

In the apparatus 10', proper design and positioning of the return bar 34 may enable the use of single-acting hydraulic motors in the hydraulic ram structure by relying on the tension springs 62 and weight of the unsplit portion of the log to return the movable end 30 of the ram structure to an appropriate retracted position and proper positioning of the unsplit portion of the log in the apparatus for subsequent splitting. However, the use of double-acting hydraulic motors is preferred to insure efficient and trouble-free automatic operation of the apparatus 10'.

Figure 7:
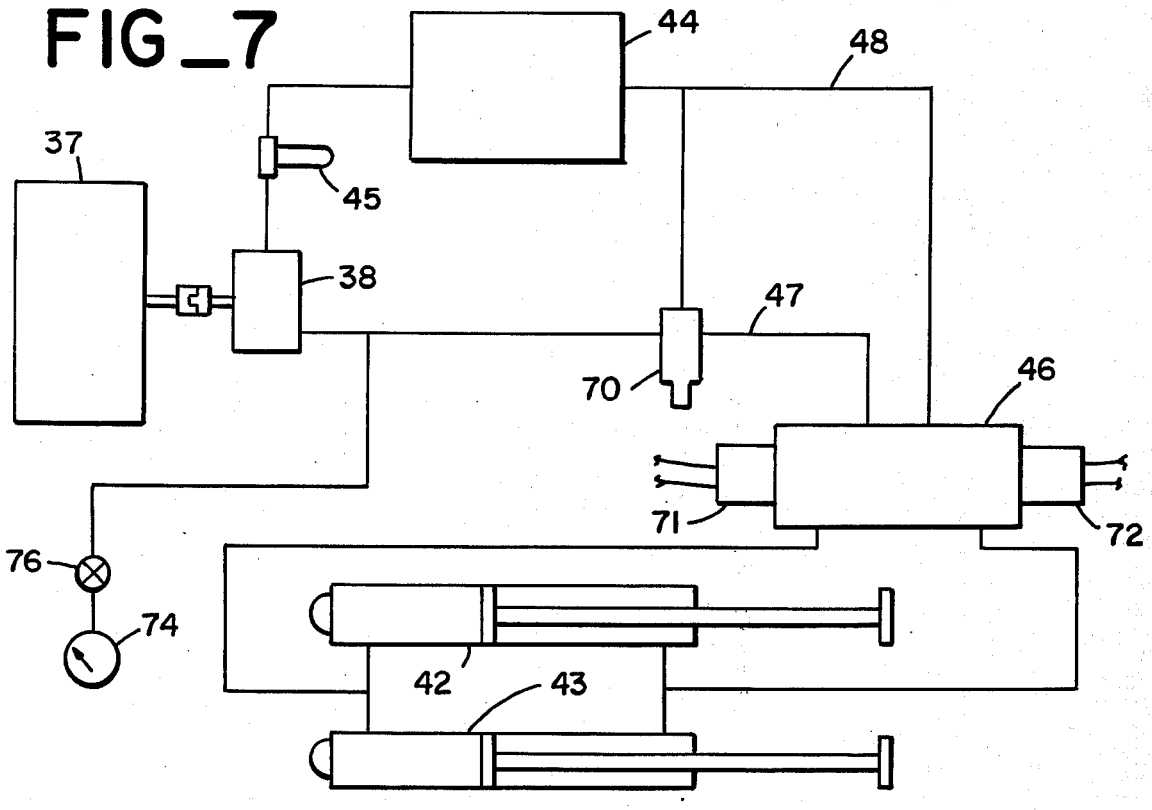
FIG. 7 is a schematic representation of the hydraulic system of apparatus in accordance with a preferred embodiment of this invention.
Figure 8:
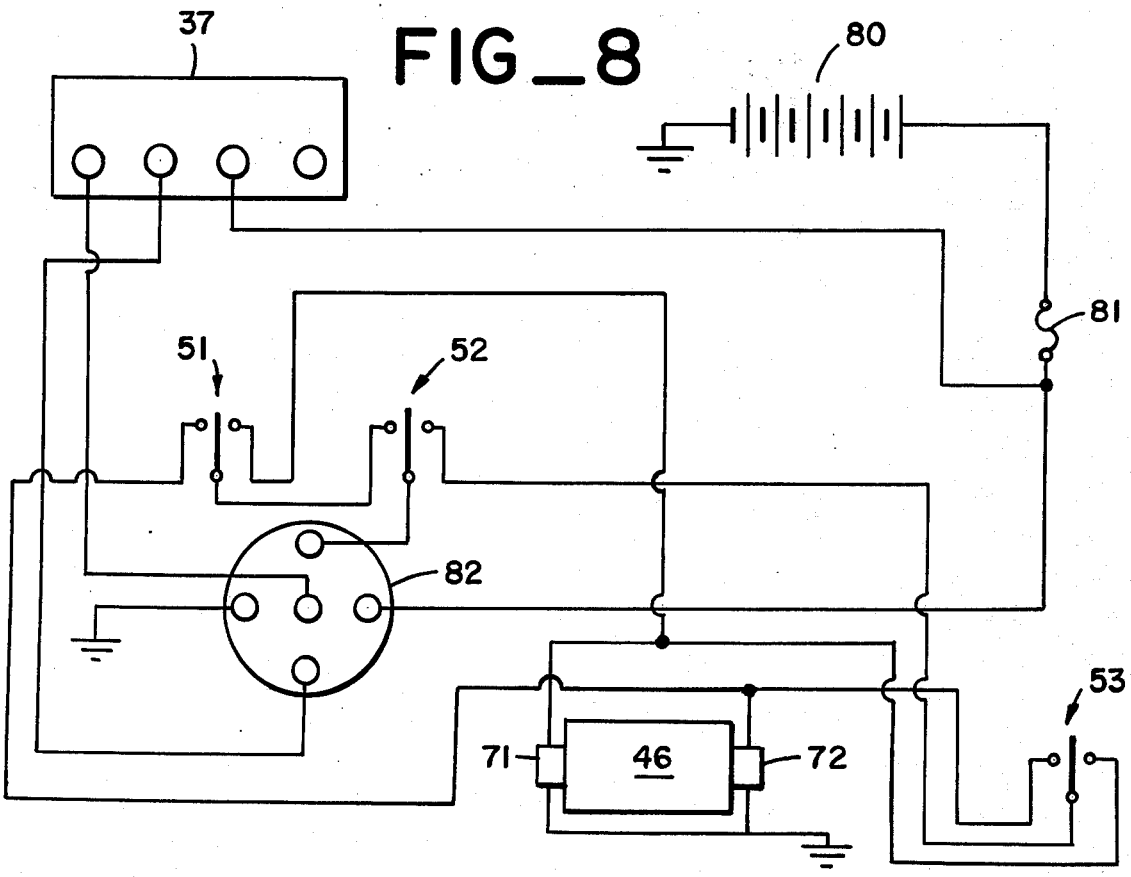
FIG. 8 is a schematic representation of the electrical system of apparatus in accordance with a preferred embodiment of this invention.

Referring to FIG. 7, the hydraulic system of apparatus in accordance with the preferred embodiment of the teaching of this invention is shown schematically. Reference numerals used in connection with FIGS. 1 through 6 are also used in FIG. 7 to designate like parts. Thus, as shown in FIG. 7, a gasoline engine 37 or other source of mechanical power is mechanically coupled to drive a hydraulic pump 38. The inlet of the hydraulic pump 38 is connected to a reservoir 44 of hydraulic fluid through an appropriate filter 45. The output of the hydraulic pump is connected to the two-position four-way valve 46 through a relief valve 70 and the hydraulic line 47. The relief valve 70 is of the type well-known in the prior art adapted to couple the output of the pump 38 to the reservoir when the fluid pressure at the relief valve 70 exceeds a selected predetermined level. The two-position four-way valve 46 is also connected to the reservoir through the hydraulic line 48.

As shown in FIG. 7, the two-position four-way valve 46 is electrically actuated by means of two integral solenoids 71 and 72. Such solenoid operated two-position four-way valves are well-known in the art and when energized, the first solenoids 71 will move the valve 46 to its first position to retract the rods of the hydraulic motors 42 and 43 in tandem as described hereinabove by connecting the pump and reservoir to such hydraulic motors through appropriate hydraulic lines as indicated. Upon actuation of the two-position four-way valve 46 to its second position by energization of the second solenoid 72, the connections of the pump and reservoir to the hydraulic motors 42 and 43 will be reversed in tandem to thereby extend the rods of such hydraulic motors as described hereinabove.

United States Patent [19]

Grigaitis et al.

[11] 3,995,673

[45] Dec. 7, 1976

[54] STABILIZED AIR BUBBLE-CONTAINING EXPLOSIVE COMPOSITIONS

[75] Inventors: Benedict John Grigaitis; Harold William Holden; Terrence Charles Matts, all of Mont Saint-Hilaire; Maurice Henry Miskow; Jean Paul Richard, both of St. Bruno; Philip Faut Lit Seto, St. Lambert, all of Canada

[73] Assignee: Canadian Industries, Ltd., Montreal, Canada

[22] Filed: Feb. 6, 1975

[21] Appl. No.: 547,474

[30] Foreign Application Priority Data

Feb. 21, 1974 Canada ..... 193099

[52] U.S. Cl. ..... 149/21; 149/38; 149/47; 149/60; 149/92; 149/108.8

[51] Int. Cl.[2] ..... C06B 45/02; C06B 33/08; C06B 31/32; C06B 25/02

[58] Field of Search ..... 149/21, 38, 46, 47, 149/60, 88, 92, 108.8, 109.2

[56] References Cited

UNITED STATES PATENTS

| | | | |
|---|---|---|---|
| 3,288,661 | 11/1966 | Swisstack | 149/60 |
| 3,397,097 | 8/1968 | Atadan | 149/46 |
| 3,522,117 | 7/1970 | Atadan | 149/46 |
| 3,653,992 | 4/1972 | Fee | 149/2 |
| 3,695,947 | 10/1972 | Edwards | 149/2 |
| 3,770,522 | 11/1973 | Tomic | 149/2 |
| 3,790,415 | 2/1974 | Tomic | 149/2 |

OTHER PUBLICATIONS

Kirt, Encyclopedia of Chemical Technology, 1st Ed. (1954), vol. 13, p. 513.

Kirt, Encyclopedia of Chemical Technology, 2nd Ed. (1969) vol. 19, p. 580 and vol. 21, p. 85.

*Primary Examiner*—Samuel W. Engle
*Assistant Examiner*—Donald P. Walsh
*Attorney, Agent, or Firm*—Donald G. Ballantyne

[57] ABSTRACT

A foamed or aerated explosive composition containing a water-soluble organic nitrate sensitizer is provided which retains sensitivity for long periods in small diameter cartridges. The dissipation or migration of entrained air or gas in the composition is substantially prevented by incorporating a blend of a foaming surfactant and a stabilizing surfactant in chosen proportions.

7 Claims, No Drawings